US012396563B2

(12) United States Patent
Koehler

(10) Patent No.: US 12,396,563 B2
(45) Date of Patent: Aug. 26, 2025

(54) FLEXING CHAIR SHELL WITH FLEXIBLE ELEMENTS

(71) Applicant: KRUEGER INTERNATIONAL, INC., Green Bay, WI (US)

(72) Inventor: Karl J. Koehler, Brillion, WI (US)

(73) Assignee: Krueger International, Inc., Green Bay, WI (US)

( * ) Notice: Subject to any disclaimer, the term of this patent is extended or adjusted under 35 U.S.C. 154(b) by 240 days.

(21) Appl. No.: 18/329,809

(22) Filed: Jun. 6, 2023

(65) Prior Publication Data

US 2024/0407554 A1 Dec. 12, 2024

(51) Int. Cl.

| | |
|---|---|
| ***A47C 3/12*** | (2006.01) |
| ***A47C 5/12*** | (2006.01) |
| ***A47C 7/44*** | (2006.01) |

(52) U.S. Cl.

CPC ..... *A47C 7/445* (2013.01); *A47C 5/12* (2013.01); *A47C 3/12* (2013.01)

(58) Field of Classification Search

CPC ..... A47C 3/12; A47C 5/12; A47C 7/445
See application file for complete search history.

(56) References Cited

U.S. PATENT DOCUMENTS 3,583,759 A * 6/1971 Kramer ..... A47C 7/029 297/452.14 X
3,669,496 A * 6/1972 Chisholm ..... A47C 7/16 297/452.15 X
4,529,247 A 7/1985 Stumpf et al.
4,585,272 A * 4/1986 Ballarini ..... A47C 3/12 297/285
4,733,910 A 3/1988 Brennan
4,744,603 A * 5/1988 Knoblock ..... A47C 3/12 297/285
4,892,356 A * 1/1990 Pittman ..... A47C 3/12 297/452.15 X
5,102,196 A * 4/1992 Kaneda ..... A47C 3/12 297/285
5,123,702 A 6/1992 Caruso
5,567,012 A * 10/1996 Knoblock ..... A47C 3/12 297/303.3
5,662,381 A * 9/1997 Roossien ..... A47C 3/12 297/452.15 X
5,725,277 A * 3/1998 Knoblock ..... A47C 1/03272 297/452.15 X
5,842,264 A * 12/1998 Roossien ..... A47C 3/12 297/440.22

(Continued)

*Primary Examiner* — Rodney B White

(74) *Attorney, Agent, or Firm* — Andrus Intellectual Property Law, LLP

(57) ABSTRACT

A chair having a one-piece molded shell including a seat and a backrest that can recline relative to the seat. One or more flexible elements are mounted to the seat such that the flexible elements restrict the inward flexing of the seat as the backrest reclines. The flexible elements are positioned to allow the initial flexing of the side edges of the seat as the backrest reclines relative to the seat. A stop member is positioned relative to the flexible elements such that the stop member limits the amount of movement of the flexible elements. The flexible elements are located between the seat and the base. The flexible elements exert a bias force on the side edges of the seat to urge the backrest to return to an initial position when a reclining force is not longer exerted on the backrest.

17 Claims, 9 Drawing Sheets

(56) References Cited

U.S. PATENT DOCUMENTS

| | | | | |
|---|---|---|---|---|
| 5,997,094 | A * | 12/1999 | Cvek | A47C 3/12 297/452.15 X |
| 6,634,717 | B2 | 10/2003 | Kown | |
| 6,779,846 | B2 | 8/2004 | Spendlove et al. | |
| 6,935,690 | B2 * | 8/2005 | Lucci | A47C 3/04 297/320 |
| 7,021,712 | B2 | 4/2006 | Spendlove et al. | |
| 7,686,395 | B2 | 3/2010 | Piretti | |
| 9,326,905 | B2 * | 5/2016 | Bhat | A47C 7/021 |
| 9,339,407 | B2 * | 5/2016 | Bhat | A47C 27/00 |
| 9,427,086 | B2 * | 8/2016 | Willingham | A47C 3/12 |
| 9,538,847 | B2 | 1/2017 | Romero | |
| 9,801,470 | B2 * | 10/2017 | Mehaffey | B29C 45/1704 |
| 10,314,400 | B2 * | 6/2019 | Colonello | A47C 7/46 |
| 11,089,874 | B2 * | 8/2021 | Colonello | A47C 3/0255 |
| 2010/0066140 | A1 | 3/2010 | Ware | |
| 2013/0082505 | A1 * | 4/2013 | Schneider | A47C 3/14 297/452.19 |
| 2021/0137271 | A1 * | 5/2021 | Parker | A47C 3/0255 |
| 2022/0087425 | A1 | 3/2022 | Smith et al. | |

* cited by examiner

FLEXING CHAIR SHELL WITH FLEXIBLE ELEMENTS

BACKGROUND

The present disclosure generally relates to a chair having a one-piece molded shell for supporting a user. More specifically, the present disclosure relates to a chair that includes one or more flexible element that limit the inward flexing of the side edges of a seat upon reclining movement of the backrest.

Plastic chairs in which a seat and a backrest are molded as a single shell are well known. In many of these chair designs, the backrest is flexible and is able to pivot and recline relative to the seat. During the reclining movement, the side edges of a transition area between the seat and the backrest along with the seat itself have a tendency to pinch inward toward the seated occupant. The more the backrest reclines, the more the side edges of the seat pinch inward toward the seated occupant.

The inventor of the present disclosure has recognized the need and desire for a chair that includes some type of element or elements that restrict the reclining movement of the backrest. The present disclosure provides one or more flexible elements that restrict the reclining movement of the backrest and create a bias force that help urge the backrest into an upright, resting position.

SUMMARY

The present disclosure relates to a chair having a molded, one-piece shell that is flexible enough to allow a backrest of the chair to recline relative to the seat. More specifically, the present disclosure relates to a chair that includes one or more flexible elements that restrict and control the flexing of the seat and provide a bias force to return the backrest to a resting position.

In accordance with one aspect of the present disclosure, a chair is provided for use by a seat occupant. The chair includes a support structure that includes a base and a plurality of legs connected to the base to support the base above a surface, such as the ground. The chair includes a one-piece molded seat shell that is supported on the base of the support structure. The seat shell includes a seat having a seating surface, a bottom surface and a pair of side edges. In addition, the seat shell includes a backrest that can pivot relative to the seat upon a reclining force applied to the backrest by the seat occupant.

When the seat occupant exerts the reclining force on the backrest, the backrest reclines and the side edges of the seat flex inward and upward. The flexing movement of the side edges is toward the seated occupant. The chair of the present disclosure includes one or more flexible members that are positioned to restrict the upward and inward flexing movement of the side edges of the seat.

In one contemplated, exemplary embodiment, the chair includes a pair of flexible element that are each positioned near one of the side edges of the seat. Each of the pair of flexible elements has a first end connected to the stationary base and a second end connected to the bottom surface of the seat. The pair of flexible elements are the connection between the base and the side edges of the seat.

In an exemplary embodiment of the present disclosure, the chair further includes a stop member positioned near each of the flexible members. The stop member is designed to limit the vertical movement of the flexible member to thereby limit the amount of reclining movement of the backrest. The stop member limits the vertical movement of the flexible member and thus the flexing of the side edges of the seat.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
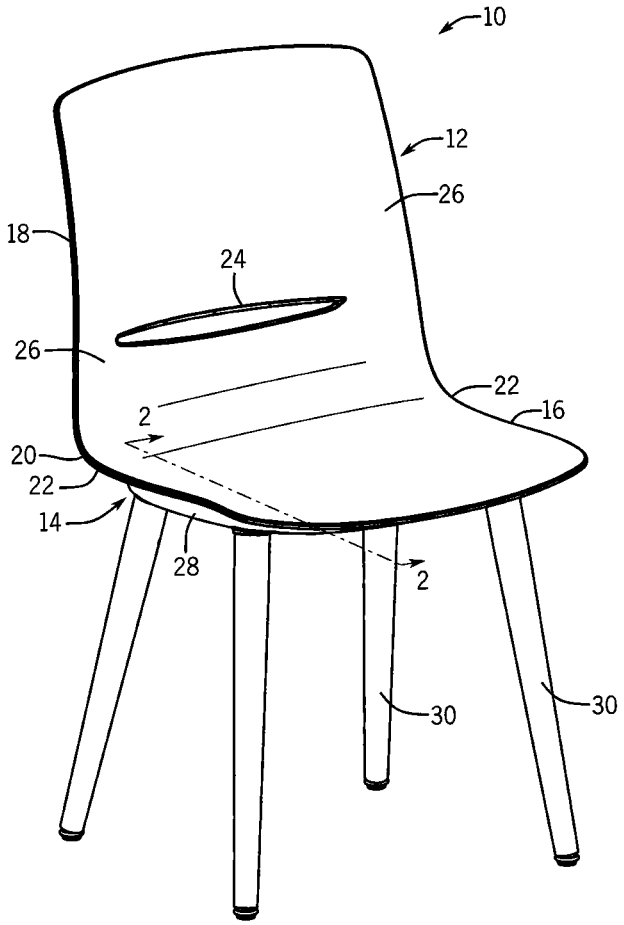
FIG. 1 is a front perspective view of a chair including a one-piece shell and support structure in accordance with the present disclosure.

FIG. 1 illustrates a chair 10 constructed in accordance with the present disclosure. The chair 10 generally includes a one-piece shell 12 that is supported above a ground surface by a support structure 14. In the embodiment illustrated in FIG. 1, the one-piece shell 12 is formed from a molded plastic material such that the one-piece shell 12 defines a seat 16 and a backrest 18 that are joined to each other by a curved transition portion 20. The plastic material that forms the one-piece shell 12 is flexible enough to allow the backrest 18 to recline upon a reclining force exerted against the backrest 10 by a seated occupant. During this reclining movement, the backrest 18 flexes rearward, which causes the side edges 22 of seat 16 to flex inward toward the center axis of the seat 16. This inward flexing of the side edges 22 of the seat 16 can impinge upon the seated occupant if the amount of flexing of the backrest 18 is not restricted. The inventor of the present disclosure recognized this need and developed the subject matter of the present disclosure to address this issue.

In the embodiment shown in FIG. 1, the backrest 18 includes a removed area 24 that creates a pair of flexing zones 26 in the backrest 18 on opposite sides of the removed area 24. Because of the lateral curves formed in the geometry of the one-piece shell 12, the flexing of the backrest 18 rearward results in a tightening of the lateral curve of the seat 16 and the transition portion 20 at the hip portion of a seated occupant. In order to restrict this inward movement of the side edges 22 of the seat 16, the present disclosure utilizes one or more flexible elements to restrict such movement, as will be described in greater detail below.

In the embodiment shown in FIG. 1, the support structure 14 for the chair 10 includes stationary base 28 that is supported by four legs 30. The base 28 can be formed from various different types of materials, such as a molded plastic, molded nylon or a cast metallic material. In the embodiment shown, the base 28 is formed from a cast metal material and securely receives each of the four legs 30.

Figure 4:
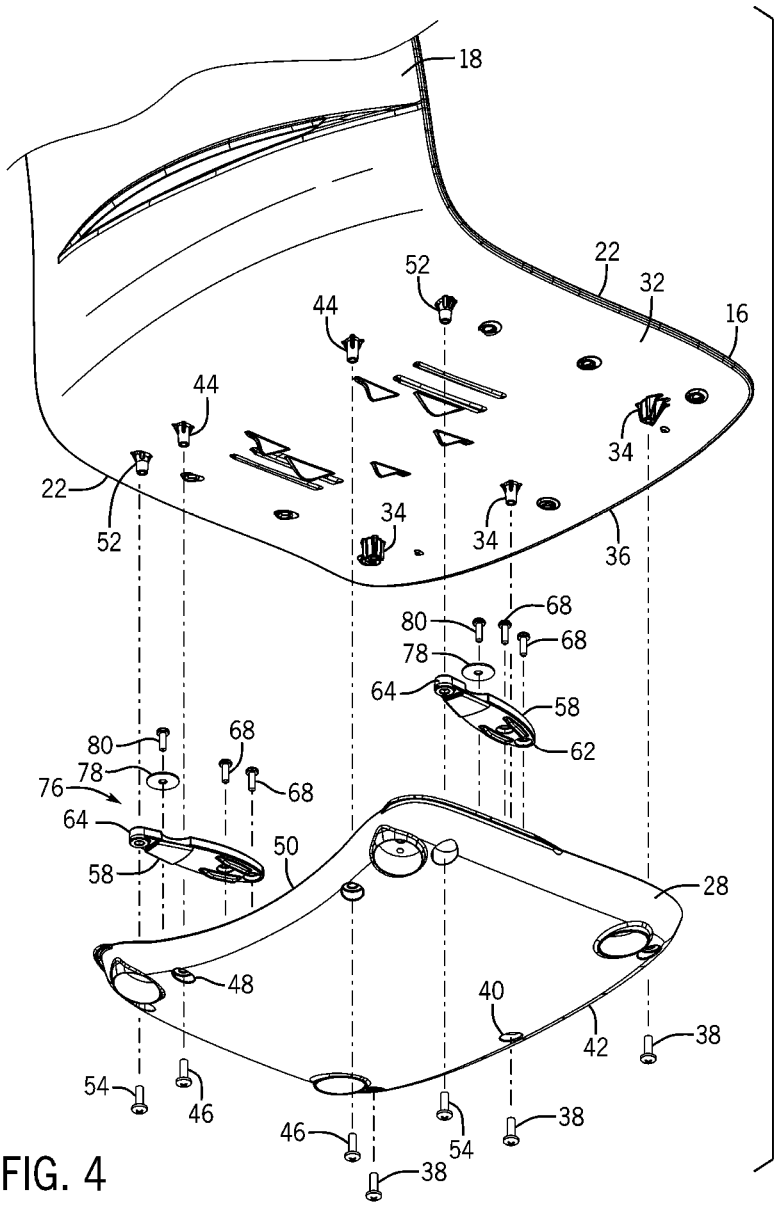
FIG. 4 is an exploded view showing the mounting components between the shell and the base.

FIG. 4 is an exploded view of the mounting arrangement between a bottom surface 32 of the seat 16 and the base 28 in accordance with the present disclosure. The mounting arrangement between these two components prevents the lateral movement of the seat 16 relative to the base 28 while also allowing the side edges 22 of the seat to flex both inward and upward upon reclining movement of the backrest 18.

As illustrated in FIG. 4, the bottom surface 32 of the seat 16 includes three front standoffs 34 positioned near the front edge 36 of the seat. Each of the front standoffs 34 includes an internally threaded opening that is designed to receive one of the front connectors 38. Each of the front connectors 38 passes through an attachment hole 40 aligned with the front standoffs 34 and located near the front edge 42 of the base 28. The threaded shaft of each of the front connectors 38 is received in the internally threaded opening formed in the front standoff 34. The series of front connectors 38 thus secure the front edge 36 of the seat 16 in a fixed position relative to the front edge 42 of the base 28. Such connection prevents the lateral movement of the front edge 36 of the seat upon reclining movement initiated by the seat occupant.

The bottom surface 32 of the seat 16 further includes a pair of rear standoffs 44 that each include a threaded inner opening designed to receive a threaded shaft of one of the pair of rear connectors 46. Each of the rear connectors 46 passes through an attachment hole 48 located near the back edge 50 of the base. The rear connectors 46 are spaced inwardly from the side edges 22 of the seat and are used to secure the center portion of the seat, near the rear edge, to the base 28.

The bottom surface 32 of the seat 16 further includes a pair of side edge standoffs 52 that are each located near one of the side edges 22 of the seat 16 and near the rear most portion of the seat 16 where the seat 16 transitions into the transition portion 20. Each of the side edge standoffs 52 include an internal threaded opening that receives a threaded shaft of a side edge connector 54. Each of the side edge connectors 54 pass through an access opening 56 formed in the base 28. The access openings 56 are sized such that the side edge connector 54 passes entirely through the base and does not engage any portion of the base 28. In this manner, the side edges 22 of the seat are able to flex both upward and inward upon reclining movement of the backrest 18.

Figure 5:
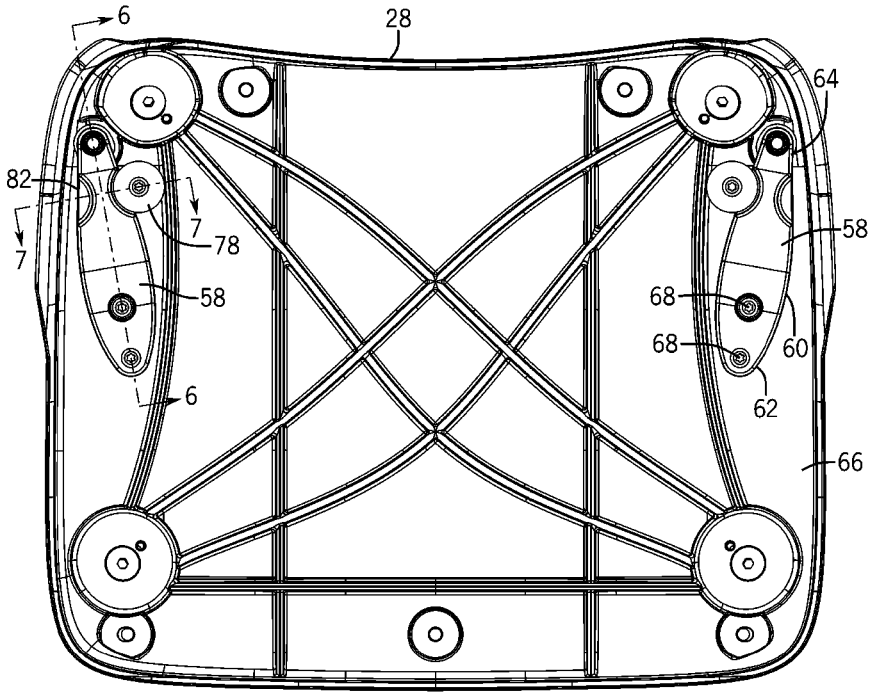
FIG. 5 is a top view of the base including the pair of resilient flexible members.

Referring now to FIGS. 4 and 5, the chair constructed in accordance with the present disclosure is designed to include a pair of resilient flexible members 58 that are mounted near the side edges 22 of the seat and are connected between the base 28 and the seat 16. As illustrated in FIG. 5, each of the flexible members 58 includes a main body 60 that extends from a first end 62 to a second end 64. Although a specific shape of the main body 60 is shown, it should be understood that the shape of the main body 60 could vary depending on the requirements for the flexible member 58. The first end 62 of the flexible member 58 is securely connected to an inner surface 66 of the base 28 using a pair of connectors 68. The pair of connectors 68 securely mount the first end 62 of the flexible member 58 to the base 28 such that the first end 62 is prevented from movement relative to the base 28.

The second end 64 of the flexible member 58 is securely mounted to one of the side edge standoffs 52 on the bottom surface 32 of the seat 16 utilizing one of the side edge connectors 54. As indicated previously, each of the side edge connectors 54 pass through the access opening 56 formed in the base 28 such that the rear portion of the seat 16 near the side edges 22 are not securely attached to the stationary base 28. Instead, the side edges 22 are able to flex upward and inward against a resilient spring-like force created by the material used of the flexible members 58.

Referring back to FIGS. 2 and 3, when a seat occupant is seated on the seat and leans back against the backrest 18 as shown by arrow 70, the plastic material used to form the one-piece shell 12 allows the side edges of the seat 16 to flex upward and inward as shown by arrow 72. As the side edge 22 flexes upward and inward, the body of the flexible member 58 secured to the seat also flexes upward, which allows the second end 64 to move upward away from the inner surface 66 of the base 28. As shown in FIG. 3, the access opening 56 allows the side edge connector 54 and the second end 64 of the flexible member 58 to move upward. When the seat occupant no longer exerts a reclining force against the backrest 18, the resilient nature of the flexible member 58 urges the backrest 18 back into the resting position shown in FIG. 2. In this manner, the flexible member 58 not only allows the flexing movement of the side edges of the seat, but also exerts a bias force on the side edges of the seat to urge the backrest back into the upright resting position shown in FIG. 2.

Figure 2:
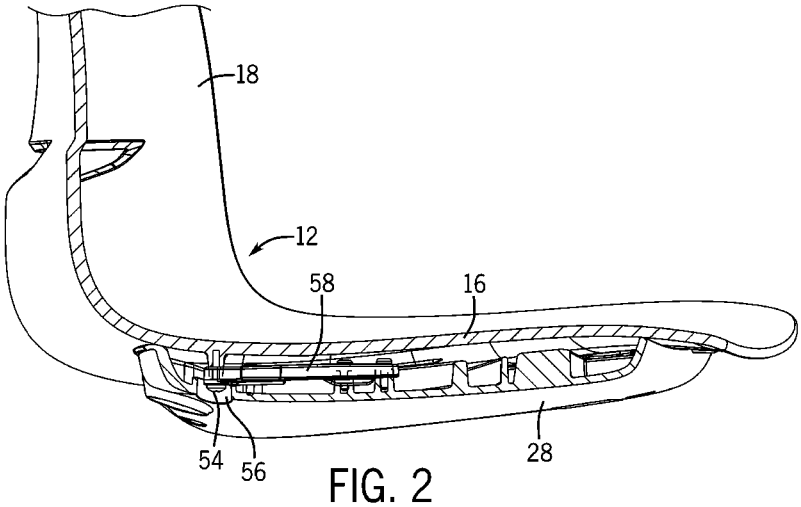
FIG. 2 is a section view taken along line 2-2 of FIG. 1 showing the resilient mounting arrangement of the present disclosure between the shell and the base.
Figure 3:
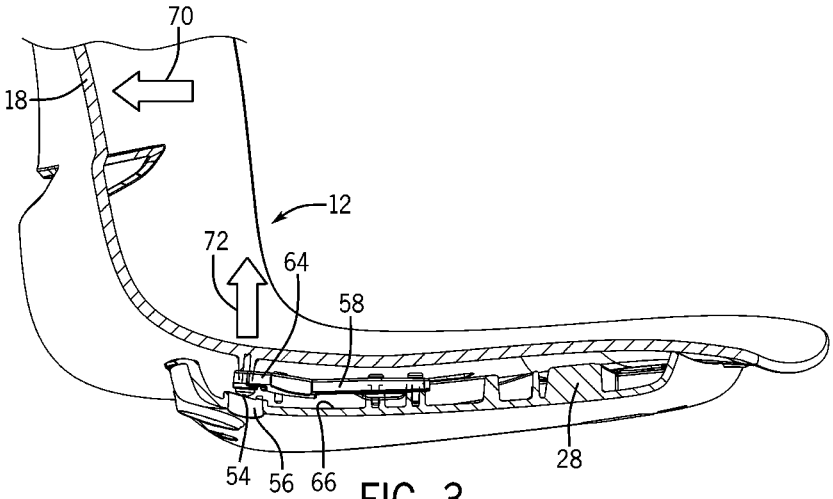
FIG. 3 is a section view similar to FIG. 2 showing the movement of the side edges of the seat upon reclining movement of the backrest.

As shown in FIGS. 2 and 3, the flexible members 58 are positioned between the seat 16 and the base 28 and are thus concealed within the chair. Hiding the flexible members 58 within the chair enhances the visual appearance of the chair while allowing for the function described above.

In the embodiment illustrated, each of the flexible members 58 can be formed from a flexible material having the desired thickness to exert the required return force on the backrest 18 while yet allowing the required flexing of the side edges of the seat inward upon the inclining movement.

Figure 6:
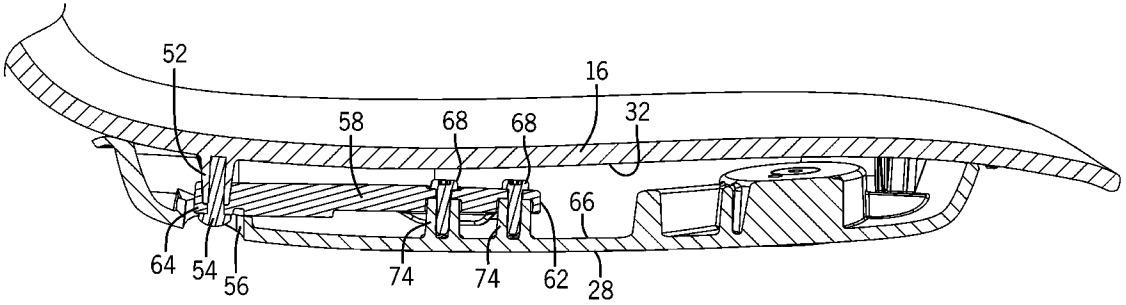
FIG. 6 is a section view taken along line 6-6 of FIG. 5 showing the mounting of one of the flexible members to both the seat and the base.

FIG. 6 more clearly illustrates the mounting of the flexible member 58 between the base 28 and the bottom surface 32 of the seat 16. As illustrated, the first end 62 of the flexible member 58 is securely mounted to the base by a pair of connectors 68 that are each received in one of a pair of standoffs 74 extending upward from the inner surface 66 of the base 28. The pair of connectors 68 thus secure the first end 62 of the flexible member 58 to the base 28. The second end 64 of the flexible member 58 is securely connected to the bottom surface 32 of the seat 16 through the side edge connector 54, which is received in the side edge standoff 52. The size of the side edge connector 54 is less than the diameter of the access opening 56 formed in the base 28 such that the second end of the flexible member 58 is movable vertically as illustrated.

Referring back to FIGS. 4 and 5, the flexible mounting system of the present disclosure further includes a pair of stop members 76 that are each associated with one of the pair of flexible members 58. The stop member 76 is designed to limit the upward movement of the second end 64 of the flexible member 58, which is illustrated by the arrow 72 in FIG. 3. The stop member is positioned and located relative to the flexible member 58 to provide a definitive stop position for the upward movement of the second end 64 of the flexible member 58. In the embodiment illustrated, the stop member 76 includes a washer 78 and a connector 80. As can be seen in FIG. 5, the washer 78 has a portion of its outer circumference that extends over a recessed area 82 formed in the flexible member 58.

Figure 8:
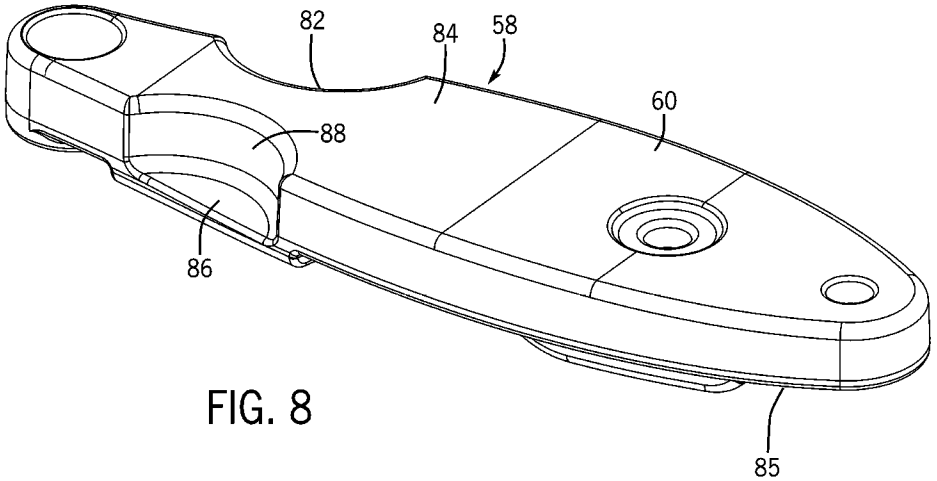
FIG. 8 is a top perspective view of the flexible member.

Referring now to FIG. 8, in the embodiment illustrated, the body 60 of the flexible member includes a top surface 84 and a bottom surface 85 space by the thickness of the body 60. The body 60 includes the pair of recessed areas 82 that each extend from the top surface 84 to a contact surface 86. The shape of the recessed area 82 is defined by an inner wall 88 that has a general shape that corresponds to the outer surface of the washer.

Figure 7:
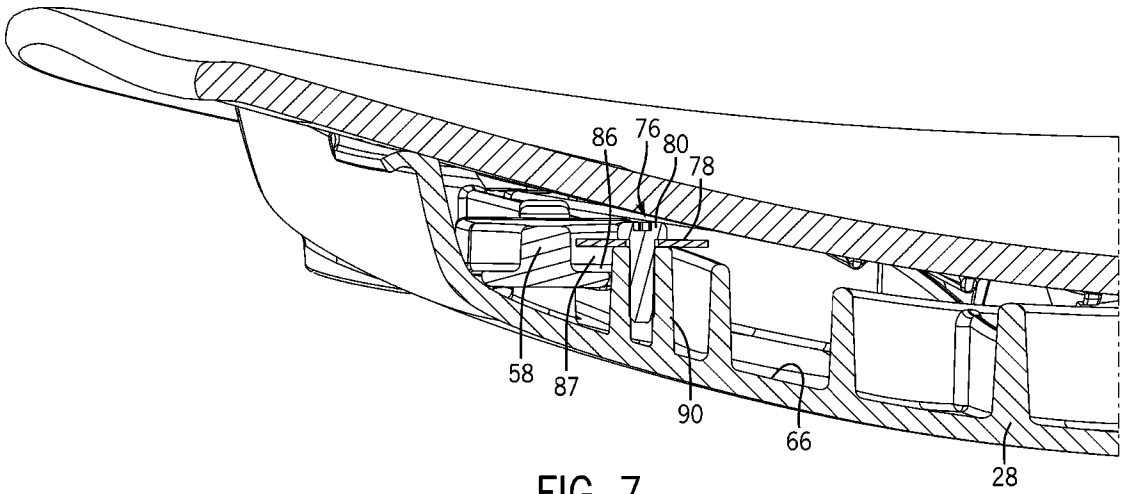
FIG. 7 is a section view taken along line 7-7 of FIG. 5 showing the position of the stop member relative to one of the flexible members.

Referring now to FIG. 7, when the flexible member is in the initial resting position, the washer 78 is spaced above the contact surface 86 to define a movement gap 87. In the embodiment shown, this movement gap 87 has a height of approximately 0.25 inches, although other heights are contemplated. When a seat occupant exerts a reclining force on the backrest, the second end of the flexible member 58 moves upward until the contact surface 86 comes in contact with the washer 78. This physical contact between the washer 78 and the contact surface 86 formed on the flexible member prevents any additional upward movement of the second end of the flexible member. In this manner, the stop member 76, and specifically the stationary washer 78, limits the amount of movement of the flexible member 58 and thus the side edges of the seat. As shown in FIG. 7, the threaded shaft of the connector 80 is received within a standoff 90 extending upward from the inner surface 66 of the base 28.

As illustrated in FIGS. 4 and 5, each of the flexible members 58 includes a stop member 76 to limit the amount of movement allowed for the second end of the flexible member. The stop member 76 could have other shapes and configurations as long as the stop member 76 limits the amount of movement of the flexible member 58. In some embodiments, the stop member 76 could be eliminated if some other mechanism is present to limit the movement of the backrest.

As described previously, each of the flexible members 58 can be formed from a molded material that has the desired flexibility and that creates the desired spring force to return the backrest to its upright position shown in FIG. 2. Although one shape of the flexible member 58 is shown in FIG. 8, it should be understood that various other shapes could be utilized while operating within the scope of the present disclosure.

Figure 9:
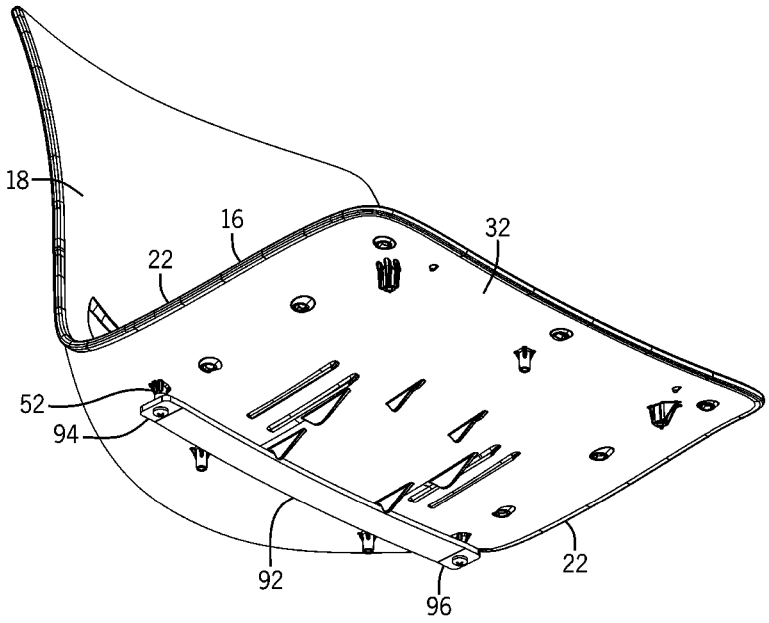
FIG. 9 is a bottom perspective view of a second contemplated embodiment of the present disclosure.
Figure 10:
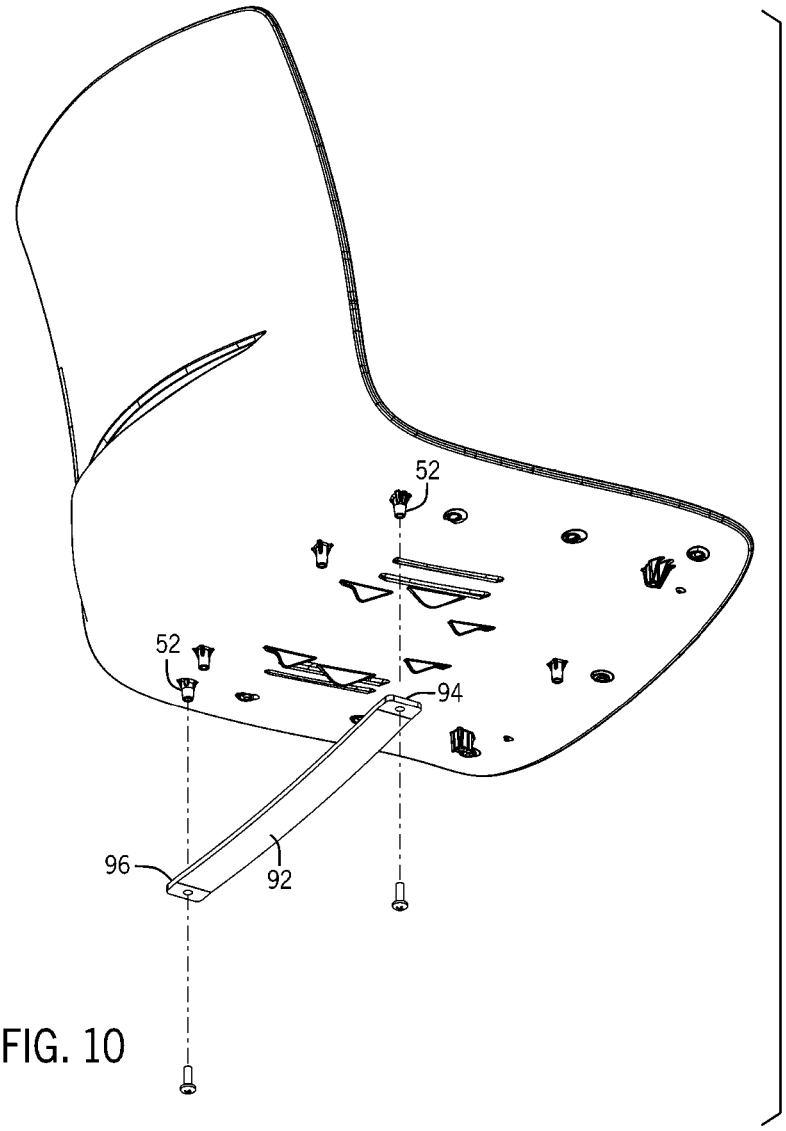
FIG. 10 is an exploded view of the second contemplated embodiment of the present disclosure.

FIGS. 9 and 10 illustrate a second embodiment of the flexible mounting arrangement in accordance with the present disclosure. As can be understood in FIGS. 9 and 10, the bottom surface 32 of the seat 16 includes the same standoffs and general configuration as in the embodiment shown in FIG. 4. In the second embodiment shown in FIG. 10, the pair of flexible members 58 previously described are replaced with a single flexible element 92 that extends across the general width of the seat 16 between the pair of side edge standoffs 52. In the embodiment illustrated, the flexible member 92 functions similar to a leaf spring and has a first end 94 and a second end 96 of the flexible member 92 securely attached to the bottom surface 32 of the seat.

In the embodiment shown in FIGS. 9 and 10, when the seat occupant exerts a reclining force on the backrest 18, the side edges 22 of the seat 16 begin to move upward as previously discussed. This upward movement of the seat edges 22 is opposed by the flexible nature of the flexible member 92. Further, when the seat occupant no longer exerts a reclining force on the backrest 18, the flexible member 92 urges the side edges 22 of the seat back to the resting position shown in FIG. 1.

In the embodiment shown in the present disclosure, flexible members 58 can be formed from different types of materials or composite combinations of various materials. As an example, the flexible elements could be steel, fiberglass, nylon, rubber or some type of plastic material. The type of material and size and configuration of the flexible member can be designed depending upon the required bias force and the amount of flexing required in a certain chair design.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

I claim:

1. A chair for use by a seat occupant, comprising:

a support structure including a base and a plurality of legs connected to the base;

a one-piece molded seat shell supported on the support structure, the seat shell including a seat and a backrest joined to each other by a transition portion, wherein the backrest pivots in relation to the seat upon reclining movement by the seat occupant, wherein side edges of the seat flex inward upon pivoting movement of the backrest; and at least one resilient flexible member positioned to restrict the flexing movement of the side edges of the seat when the backrest pivots; and a stop member mounted to the base;

wherein the stop member is spaced apart from the flexible member and contacts the flexible member to limit the vertical movement of the flexible member.

2. The chair of claim 1 wherein the at least one flexible member restricts the vertical movement of the side edges of the seat upon reclining movement of the backrest.

3. The chair of claim 1 wherein the at least one flexible member includes a first end connected to the base and a second end connected to the seat.

4. The chair of claim 1 wherein the stop member contacts the flexible member upon inward flexing movement of the side edges of the seat.

5. A chair for use by a seat occupant, comprising:

a support structure including a base and a plurality of legs connected to the base;

a one-piece molded seat shell supported on the support structure, the seat shell including a seat having a seating surface, a bottom surface and a pair of side edges and a backrest joined to the seat by a transition portion, wherein when the backrest pivots in relation to the seat upon reclining movement by the seat occupant, the side edges of the seat flex inward; and a pair of resilient flexible members positioned to restrict the inward flexing movement of the side edges of the seat when the backrest pivots; and a pair of stop members each mounted to the base;

wherein the pair of stop members are each spaced from one of the pair of flexible members such that the flexible members contact the stop members to limit vertical movement of one of the pair of flexible members.

6. The chair of claim 5 wherein each of the flexible members restricts the vertical movement of the side edges of the seat upon reclining movement of the backrest.

7. The chair of claim 5 wherein each of the flexible members includes a first end connected to the base and a second end connected to the bottom surface of the seat.

8. The chair of claim 7 wherein each of the flexible members is located adjacent to one of the side edges of the seat.

9. The chair of claim 7 wherein each of the flexible members is formed from a solid flexible material such that the second end is movable relative to the first end.

10. The chair of claim 5 wherein the flexible members contact the stop members upon inward flexing movement of the side edges of the seat.

11. The chair of claim 5 wherein the seat is secured to the base to prevent movement of the seat along the base such that pivoting movement of the backrest creates the inward movement of the side edges of the seat.

12. A chair for use by a seat occupant, comprising:

a support structure including a base and a plurality of legs connected to the base;

a one-piece molded seat shell supported on the support structure, the seat shell including a seat having a seating surface, a bottom surface and a pair of side edges and a backrest joined to the seat by a transition portion, wherein when the backrest pivots in relation to the seat upon reclining movement by the seat occupant, the side edges of the seat flex inward and upward;

a pair of resilient flexible members positioned to restrict the inward and upward flexing movement of the side edges of the seat when the backrest pivots; and a pair of stop members each mounted to the base and spaced from one of the pair of flexible members;

wherein the pair of stop members are configured to contact one of the pair of flexible members to limit the vertical movement of one of the pair of flexible members.

13. The chair of claim 12 wherein each of the flexible members includes a first end connected to the base and a second end connected to the bottom surface of the seat.

14. The chair of claim 12 wherein the flexible members contact the stop members upon inward flexing movement of the side edges of the seat.

15. The chair of claim 12 wherein the seat is secured to the base to prevent movement of the seat along the base such that pivoting movement of the backrest creates the inward movement of the side edges of the seat.

16. The chair of claim 12 wherein each of the flexible members is located adjacent to one of the side edges of the seat.

17. The chair of claim 12 wherein each of the flexible members includes a top surface and a contact surface recessed from the top surface, wherein the stop member contacts the contact surface to limit the movement of the flexible member.

* * * * *